US005690854A

United States Patent [19]

Brückner et al.

[11] Patent Number: 5,690,854

[45] Date of Patent: Nov. 25, 1997

[54] REGULATION AND CLOSURE APPARATUS FOR A METALLURGICAL VESSEL

[75] Inventors: Raimund Brückner, Engenhahn-Niedernhausen, Germany; Rick Ardell, Loveland; Bernhard Schiefer, Cincinnati, both of Ohio

[73] Assignee: Didier-Werke AG, Wiesbaden, Germany

[21] Appl. No.: 702,633

[22] PCT Filed: Nov. 25, 1995

[86] PCT No.: PCT/EP95/04649

§ 371 Date: Nov. 19, 1996

§ 102(e) Date: Nov. 19, 1996

[87] PCT Pub. No.: WO96/20801

PCT Pub. Date: Jul. 11, 1996

[30] Foreign Application Priority Data

Jan. 2, 1995 [DE] Germany ..... 195 00 012.9

[51] Int. Cl.[6] ..... B22D 41/14

[52] U.S. Cl. ..... 222/593; 222/594; 222/598; 266/237

[58] Field of Search ..... 266/237; 222/593, 222/594, 598, 599

[56] References Cited

U.S. PATENT DOCUMENTS

| | | | |
|---|---|---|---|
| 4,655,237 | 4/1987 | Gloor et al. | 266/237 |
| 4,905,876 | 3/1990 | Gimpera | 222/598 |
| 5,078,306 | 1/1992 | Keller et al. | 222/598 |
| 5,350,159 | 9/1994 | Parker | 266/237 |

FOREIGN PATENT DOCUMENTS

| | | | |
|---|---|---|---|
| 268559 | 11/1988 | Japan | 222/593 |
| 493296 | 2/1976 | U.S.S.R. | 222/594 |

*Primary Examiner*—Scott Kastler
*Attorney, Agent, or Firm*—Wenderoth, Lind & Ponack

[57] ABSTRACT

A regulation and closure apparatus for a metallurgical vessel includes a stator to be disposed in a vessel wall and a rotor is rotatably supported in the stator for choking or blocking melt flow. A heating capability is provided in that the rotor is encompassed by an inductor to whose field melt in a through-passage channel in the rotor or the rotor can be coupled electromagnetically.

3 Claims, 1 Drawing Sheet

REGULATION AND CLOSURE APPARATUS FOR A METALLURGICAL VESSEL

BACKGROUND OF THE INVENTION

The invention relates to a regulation and closure apparatus for use on a metallurgical vessel and including a stator to be disposed in a vessel wall and a rotor is rotatably supported within, the stator and the rotor including throughflow openings which through rotation of the stator can be made to coincide, and the rotor having a through-passage channel for melt.

Such apparatus is described in EP 0 361 052 B1. Heating the melt in the region of this apparatus is not provided. In extreme cases the melt can zonally assume temperatures which are too low for smooth operation. For example, the melt can solidify between sealing surfaces which exist in areas surrounding the throughflow openings.

DE 44 05 082 A1 described an electromagnetic throughflow regulation device (EMV) with a nozzle in combination with an On/Off valve, namely a slide closure. Since the nozzle comprises an electrically non-conducting material, the melt therein couples, but not the nozzle itself, to the electromagnetic field of a coil. In the slide closure the electromagnetic field for the purpose of melting is said to couple to potentially solidified melt. Since the slide is far outside the field of the coil, this can hardly be achieved, at best with long time delays.

Coupling of the melt for the purpose of throughflow regulation always entails a temperature increase of the melt. However, choking the melt flow is not possible independently of heating the melt.

SUMMARY OF THE INVENTION

The invention addresses the problem of providing a regulation and closure apparatus of the above stated type in which choking or regulation and closure of a melt flow from a vessel is integrated with a capability of heating the melt. The heating takes place preferably independently of the regulation or closure function.

According to the invention the above problem is solved by providing a regulation and closure apparatus of the above type whereby the rotor is encompassed by an inductor to whose field the melt in the through-passage channel or the rotor can be coupled electromagnetically. With this apparatus, by rotation of the rotor, the melt flow can be choked and interrupted and the melt heated so that the melt does not solidify or is meltable after a potential solidification or, if necessary, is reheatable.

If the rotor is coupled to the electromagnetic field, the melt is heated through the transfer of heat from the rotor.

If the melt itself is coupled to the electromagnetic field, the melt is heated directly. Closing can take place independently by rotation of the rotor. A choking function results from the effect of the electromagnetic field. This can be augmented through a displacement body in the through-passage channel. The melt flow additionally can also be controlled by rotation of the rotor.

BRIEF DESCRIPTION OF THE DRAWINGS

Further advantageous features of the invention will be apparent from the following description with reference to the accompanying drawings, wherein.

DETAILED DESCRIPTION OF THE INVENTION

Figure 1:
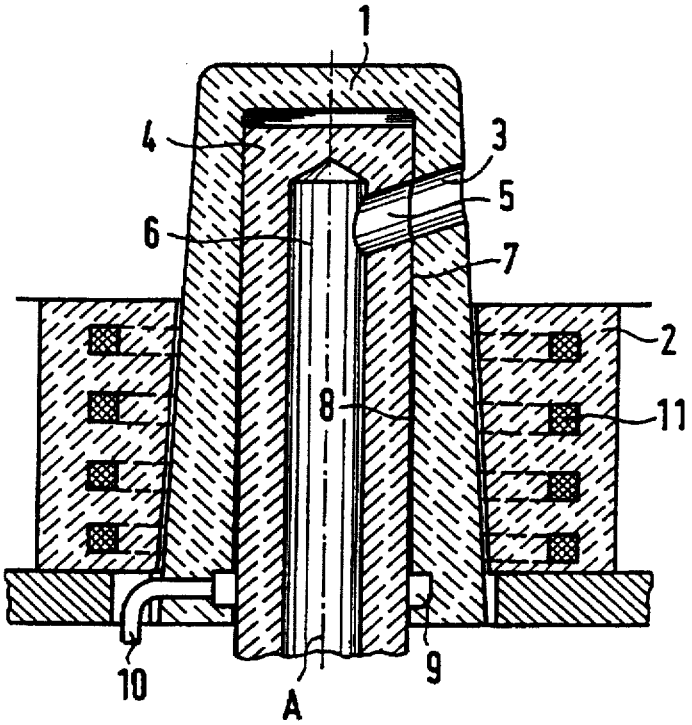
FIG. 1 is a sectional view of a regulation and closure apparatus for a metallurgical vessel according to an embodiment of the inventions.

A stator (1) of a refractory ceramic material is set into a vessel bottom (2) of a metallurgical vessel. The stator (1) includes laterally at least one throughflow opening (3) in which terminates the interior of the vessel. In the stator (1) a hollow cylindrical rotor (4) is supported rotatably about a vertical axis (A). The rotor (4) includes at least one throughflow opening (5) corresponding to the throughflow opening (3) and terminates in a through-passage channel (6) disposed in the rotor (4).

Between stator (1) and rotor (4), in areas or portions surrounding the throughflow openings (3, 5), are cylindrical sealing surfaces (7). Below the sealing surfaces (7) is a clearance (8) terminating in an annular gap (9) into which inert gas can be introduced through a line (10).

By rotating the rotor (4) in the stator (1) the throughflow openings (3, 5) can be made to coincide more or less, whereby the melt flow from the interior of the vessel into the through-passage channel (6) can be more or less choked and interrupted.

The rotor (4) is encompassed by an inductor (11) which is formed by a cooled electromagnetic coil. In the illustrated embodiments the inductor (11) is built into the vessel bottom (2) which for this purpose can comprise special perforated brick. However, it is also possible to place the inductor (11) into the stator (1). In both illustrated embodiments the stator (1) comprises an electrically non-conducting refractory ceramic material.

In the embodiment of FIG. 1 the rotor (4) is produced of an electrically conducting refractory ceramic material, for example a resin-bonded material of high alumina content. The rotor (4), but not or only insignificantly the melt flowing through the through-passage channel (6), is thereby coupled to the electromagnetic field of the inductor (11).

The operational function of the embodiment according to FIG. 1 is as follows:

For choking and blocking the melt flow, the rotor (4) is rotated about the axis (A) in a manner known per se. Independently thereof the melt temperature can be affected. To this end, the inductor (11) is switched on whereby the rotor (4) is heated. The heat of the rotor (4) is transferred by heat conduction and/or heat radiation to the melt in the through-passage channel (6) and in the throughflow opening (5). The melt temperature can thereby be increased in the desired manner whereby it is avoided, inter alia, that melt solidifies between the sealing surfaces (7). If in the closed position of the rotor (4) some melt solidifies between the sealing surfaces (7) it can be melted by switching on the inductor (11).

Figure 2:
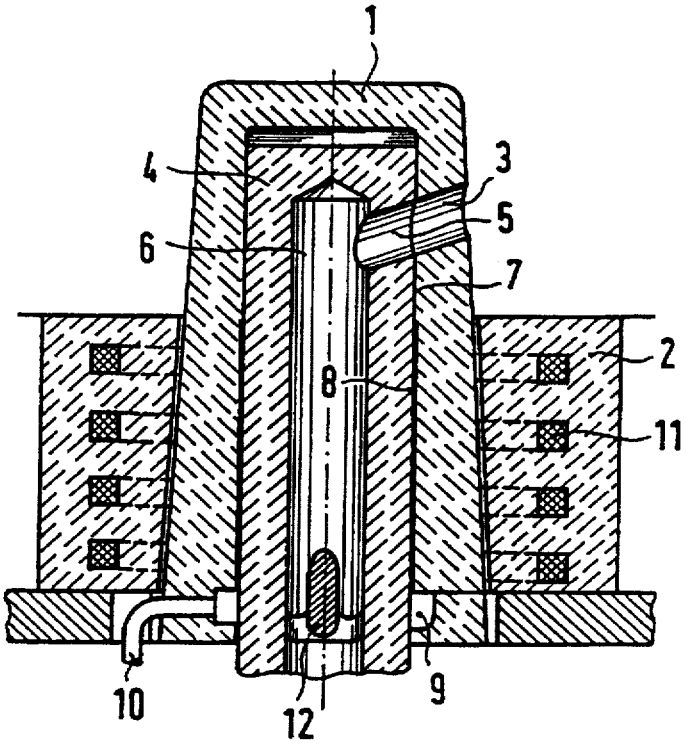
FIG. 2 is a sectional view similar to FIG. 1 but of a further embodiment.

In contrast to the embodiment according to FIG. 1, in the embodiment according to FIG. 2 the rotor (4) is comprised of an electrically non-conducting refractory ceramic material such as zirconium oxide. The rotor (4) thus is not coupled to the electromagnetic field of the inductor (11). In the embodiment according to FIG. 2 a central displacement body (12) is built into the through-passage channel (6) of the rotor (4). Except for this feature, the structure is identical to that of FIG. 1.

The operational function of the embodiment according to FIG. 2 is as follows:

The melt flow can be choked and blocked by rotation of the rotor (4). If the inductor (11) is switched on, its electromagnetic field acts directly on the melt in the through-passage channel (6) and in the throughflow openings (5, 3). This entails, on the one hand, a constriction of the melt flow cross section and therewith choking of the melt stream and, on the other hand, the heating of the melt. The choke effect is augmented by the displacement body (12). Thus, regulation of the melt flow can be attained through the electromagnetic field of the inductor (11) alone and, if necessary, additionally through rotation of the rotor (4). The displacement body (12) is not absolutely required for this purpose. Heating of the melt ensures that it cannot solidify.

In contrast to the embodiment according to FIG. 1, in the embodiment according to FIG. 2 an interdependence between the choke effect and the heating of the melt from the coupled-in electromagnetic field exists.

We claim:

1. A regulation and closure apparatus for use with a metallurgical vessel, said apparatus comprising:

a stator to be disposed in a vessel walls a rotor rotatably supported in said stator;

said stator and rotor having throughflow openings which, by rotation of said rotor, can be made to coincide to receive melt from the vessel, and said rotor having therein a through-passage channel to receive the melt;

an inductor encompassing said rotor and operable to generate an electromagnetic field; and said rotor comprising an electrically conducting, refractory ceramic material, whereby said rotor but not the melt therein is coupled to said field of said inductor, thus heating said rotor, with said rotor transferring heat to the melt.

2. An apparatus as claimed in claim 1, wherein said material comprises a resin-bonded material of high alumina content.

3. An apparatus as claimed in claim 1, wherein said inductor is operable to be disposed in the vessel wall or is disposed in said stator.

* * * * *